United States Patent [19]

Thomas et al.

[11] 4,366,651

[45] Jan. 4, 1983

[54] FIXING DEVICES

[75] Inventors: Howard M. Thomas; Graham R. Duke, both of Newport, Wales

[73] Assignee: Newport Borough Council, of Civic Centre, Newport, Wales

[21] Appl. No.: 192,832

[22] Filed: Oct. 1, 1980

[30] Foreign Application Priority Data

Oct. 6, 1979 [GB] United Kingdom ..... 7934770

[51] Int. Cl.[3] ..... F16B 5/00; F16B 13/06

[52] U.S. Cl. ..... 52/127.12; 52/514; 52/562; 411/33

[58] Field of Search ..... 52/514, 127, 562, 711; 411/32–34, 37, 38

[56] References Cited

FOREIGN PATENT DOCUMENTS

| | | | |
|---|---|---|---|
| 2607451 | 9/1976 | Fed. Rep. of Germany | 411/33 |
| 2643154 | 4/1977 | Fed. Rep. of Germany | 411/33 |
| 183456 | 4/1963 | Sweden | 411/33 |
| 1411077 | 10/1975 | United Kingdom | 52/127 |

*Primary Examiner*—J. Karl Bell

*Attorney, Agent, or Firm*—Larson and Taylor

[57] ABSTRACT

A fixing device is disclosed which in its form described in detail is utilizable as a replacement wall tie anchorable between the two leaves of an existing cavity wall. In this form the device consists of a stainless steel bolt (2) having a stop end (3) with mounted thereon in order from the stop end a deformable sleeve (4), a rigid sleeve (5), a deformable sleeve (6), a rigid sleeve (7), a nut (8), a rigid sleeve (9), a deformable sleeve (10), a rigid sleeve (11) and a nut (12). In use the device is inserted in coaxial bores (15A, 15B) drilled from outside a building through the outer leaf (14) and into the inner leaf (13) of a cavity wall. The nut (8) is tightened to expand the sleeve (4) in the bore in the inner leaf and the nut (12) is tightened to expand the sleeve (10) in the bore in the outer leaf (14) and in this way a wall tie is placed with minimum damage to the wall. In particular the internal surface of the inner leaf is not pierced, and re-building of an unstable wall is avoided.

5 Claims, 1 Drawing Figure

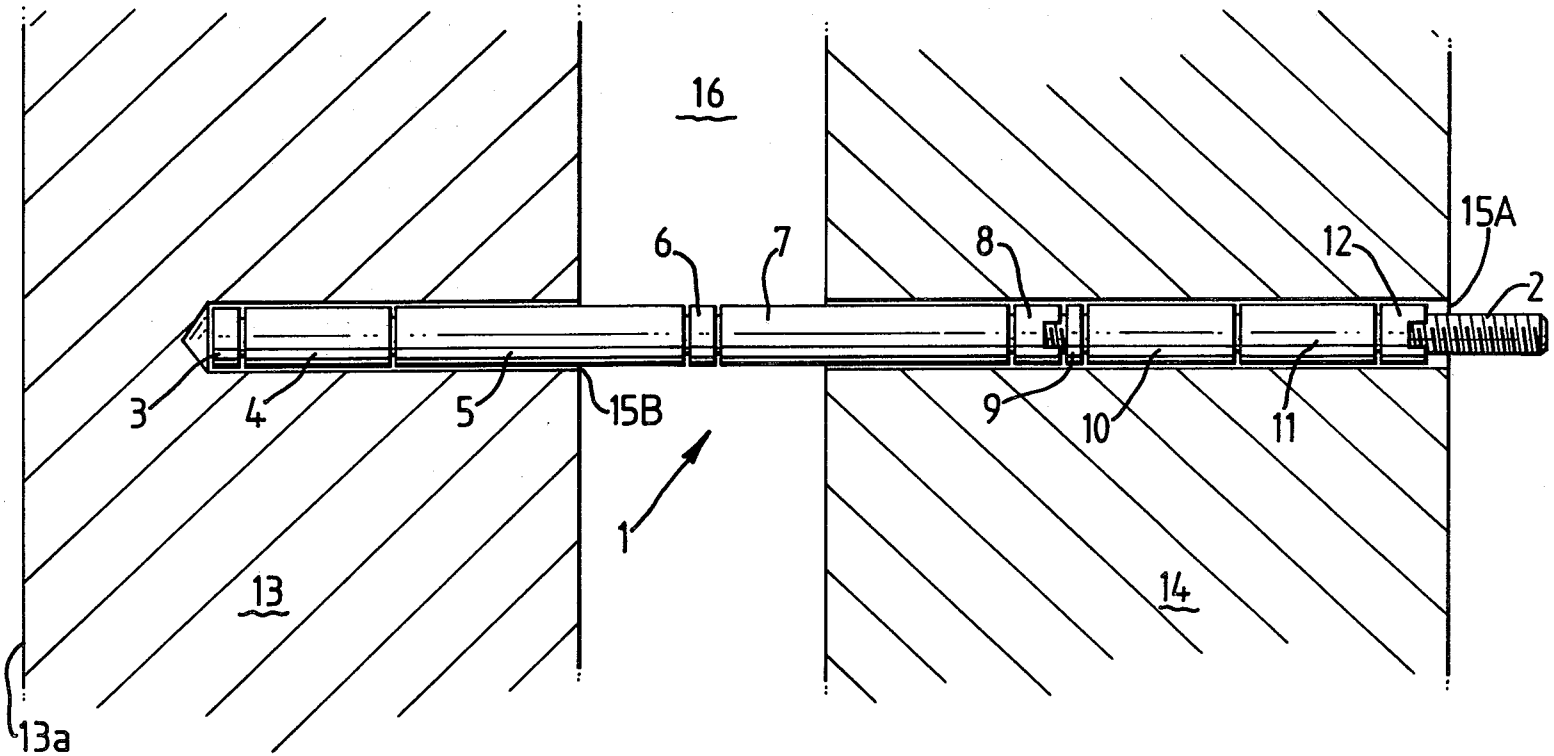
15A
2
12
11
14
10
9
8
7
16
6
15B
1
5
4
13
3
13a

FIXING DEVICES

This invention relates to fixing devices. It is particularly concerned with devices that can be fixed between two spaced-apart members fast with each of the members, and is especially concerned with devices that can be used to tie together the two leaves of a house wall of so-called cavity construction.

A particular problem that is arising in Britain is in connection with pre-1939 built houses having cavity walls. In some cases these walls are being affected in varying degrees by horizontal fractures occurring in the external leaf of the external walls at intervals of 12" to 18" (300 mm to 450 mm) vertically. This problem arises because black ash mortar, composed of a mixture of hydrated lime and finely ground ash, was used in some areas of the country as a traditional material in house construction. The ash, dependent on the location, could consist of boiler ash, incorporating a high percentage of unburned coal, and this ash in moist conditions, particularly when it contains large amounts of sulphide, tends to oxidize to sulphates and cause corrosion in the metal ties which are built into the leaves of a cavity wall as it is constructed. These ties span the two leaves, anchored in each, and are essential to provide mutual support between the leaves.

The metal wall ties consist, in many instances, of a galvanized or bitumen coated metal flat bar 8"×¾"×⅛" (200 mm×18 mm×3 mm) with fish-tailed ends that are built into each leaf of the cavity wall. The corrosive effect of the mortar destroys the galvanizing or the bitumen coating, and exposes the metal beneath. The moisture in the wall then sets up rusting in the wall tie which is progressive and causes, firstly build up of rust on the tie which causes the joint between the bricks, into which the tie was built originally, to expand and fracture the walls, particularly the external leaf, at intervals vertically of approximately 12" to 18" (300 mm to 450 mm), and secondly disintegration of the metal, such that in extreme cases the portion of the tie in the wall is destroyed and the stability of the wall is seriously affected, necessitating demolition and rebuilding of the external walls if this is possible, and if not, demolition of the building.

Where both leaves of the cavity wall are affected then demolition and rebuilding of the external walls appears to be the only answer. However, where only the external leaf of the wall is affected, because it is the leaf exposed to the weather and therefore has a high moisture content, the inner leaf remains as a possible support for the outer leaf if the outer leaf can be re-tied thereto by fastening devices replacing the original wall ties.

Where houses are in occupation it is desirable that remedial work be carried out without removing the occupants to other houses, but with as little interference as possible with the living conditions of the occupants and without penetrating through the internal face of the inner leaf to the detriment of internal decorations and fittings which would be costly to make good.

Fixing devices are known that can serve for anchoring brackets, joists or other articles to walls, floors or other structures, and which comprise a bolt adapted for insertion in coaxial bores of substantially similar diameter in the article and structure and having an enlarged head at one end, a cylindrical sleeve of deformable material loosely mounted on the bolt with one end abutting against the head, a non-deformable metallic sleeve mounted on the bolt for abutment with the other end of the deformable sleeve, and a nut that can be screwed along the bolt to urge the metallic sleeve to compress the deformable sleeve longitudinally thereof and thus expand it laterally to increase its outer diameter whereby the device can be locked fast in the bore(s) in which the deformable sleeve is engaged. Such devices are secured in position by a single tightening operation and are therefore not suitable for use to tie together two spaced-apart members in circumstances where it is essential that the device should be satisfactorily anchored in each of the two members.

According to the present invention there is provided a fixing device that can be anchored in bores formed co-axially in each of two spaced-apart members, the device comprising a screw-threaded member that can be passed through the bore in one member so as to extend through this one member and into the bore in the other member, a first sleeve mountable on the screw-threaded member so as to be entered in the bore in said other member and between a stop on the screw-threaded member and means mountable on the screw-threaded member for applying axial force to the first sleeve, a second sleeve mountable on the screw-threaded member so as to be entered in the bore in said one member and between said first means and a second means mountable on the screw-threaded member for applying axial force to the second sleeve; the first and second sleeves being of deformable material such that axial force applied by said first means expands the first sleeve in the bore in said other member to lock the device in this bore, and axial force applied by said second means expands the second sleeve in the bore in said one member to lock the device in this bore, said first means being actuable prior to actuation of said second means. Since the first force-applying means of the present device is actuable before the second such means is actuated, it can be ensured, when anchoring the device in two spaced-apart members, that the device is satisfactorily anchored in one member, whereafter the device can be satisfactorily anchored in the other member. It will be appreciated from the above that a particular use for such a device is as a replacement for a damaged wall tie in a wall of cavity construction. By using the present devices a building can be made stable at a cost considerably less than the cost of demolishing the external wall and rebuilding, without removing the occupants and with minimal damage.

For a better understanding of the invention and to show how the same may be carried into effect, reference will now be made, by way of example, to the accompanying drawing, in which the single FIGURE diagrammatically illustrates a fixing device positioned to span the two leaves of a cavity wall.

The fixing device 1 shown in the FIGURE consists, in its entirety, of a stainless steel threaded bolt 2, with a fixed stop end 3, over which are slid a series of stainless steel and polyvinylchloride sleeves 4 to 7 and 9 to 11 that are held on the bolt 2 by two threaded and slotted nuts 8 and 12, the sleeves and nuts being all of the same outside diameter. Where the device is to be used as a replacement wall tie in a wall of conventional cavity construction having inner and outer leaves 13 and 14, each in the range of approximately 100 mm to 125 mm thick, separated by a cavity approximately 50 mm wide, the various components of the fixing device have the following dimensions:

Overall length of bolt 2=269 mm
Length of stop end 3=6 mm
Length of sleeve 4=31 mm
Length of sleeve 5=59 mm
Length of sleeve 6=6 mm
Length of sleeve 7=59 mm
Length of nut 8=10 mm
Length of sleeve 9=4 mm
Length of sleeve 10=31 mm
Length of sleeve 11=28 mm
Length of nut 12=10 mm
Outside diameter of each nut and sleeve=12 mm It is the sleeves 5,7, 9 and 11 that are of stainless steel, that is they are of rigid material, and the sleeves 4,6 and 10 that are of polyvinylchloride, that is of deformable material. The sleeves 5 and 7 are identical to one another, as are the two nuts 8 and 12.

To place the device in a cavity wall there are first drilled at a diameter of 13 mm, to a depth of approximately 250 mm., a bore 15A through the outer leaf 14 and a bore 15B into the inner leaf 13, the bore 15B in the inner leaf terminating short of the inner face 13A of the inner leaf 13. These bores 15A, 15B are cleaned with an air puffer device and the bolt 2 is inserted thereinto with the sleeves 4, 5, 6 and 7 mounted thereon stop end 3 first and in the order 4-5-6-7 from the stop end 3, the sleeves being held loosely in place by the nut 8. With the stop end 3 fully home in the bore 15B the sleeve 4 is wholly within the bore 15B in the inner leaf 13. The sleeve 5 is partly within the bore 15B but projects out into the cavity 16 between the inner and outer leaves. The sleeve 6 is in the cavity 16. The sleeve 7 is partly within the cavity 15A in the outer leaf 14 and projects into the cavity 16. The nut 8 is in the cavity 15A. Once the device 1 has been so located the nut 8 is driven down the bolt 3, operated by a long tube screw driver with a socket head inserted over the bolt and rotated from the exterior, so that the polyvinylchloride sleeves 4 and 6 are compressed axially and therefore expanded radially by the compression applied thereto from the nut via the metal sleeves 5 and 7. The maximum torque applied to the nut 8 is 5 ft/lbs (0.69 kgm) since anything in excess of this torque could split the brick or concrete block into which the bolt is inserted.

The radial expansion of the sleeve 4 locks the bolt fast in the bore 15B in the inner leaf 13 whilst the sleeve 6, because it is in the cavity 16 and its expansion is therefore unrestrained, forms a collar which acts to form drips and thereby prevent passage of moisture across the cavity.

With the device now locked in the inner leaf 10 the remaining sleeves 9, 10 and 11 are placed on the bolt 2 in the order 9-10-11 and the nut 12 is screwed down onto these sleeves, to the same maximum torque as the nut 8, so that the polyvinylchloride sleeve 10 expands and locks in the bore 15A in the outer leaf 14. Thus the device is locked to each of the two leaves 13 and 14 and serves as a wall tie. The sleeves 10 and 11, and the nut 12, are within the bore 15A in the outer leaf 14 so that the wall can be made good by cutting off the surplus length of the bolt 2 outside the outer leaf 14 and making good the hole with mortar.

It will be appreciated that the whole of the operation of installing the device 1 to act as a wall tie is effected from the exterior of the house without disturbing the internal wall surface or decoration. As the device is locked first to the inner leaf independently of the outer leaf, and then to the outer leaf, it can be ensured that the device has, in fact, been made satisfactorily fast with both leaves. The materials selected (stainless steel and polyvinylchloride) give to the device when used in this way an expected service life of at least thirty years.

It is to be noted that when used as a wall tie bolt the device needs to withstand a tensile stress of 300 lbs (136 kgs). The device described has, under test, withstood a minimum of 1300 lbs (590 kgs) and in excess of a ton (1000 kgs) on a number of occasions.

An average three-bedroomed semi-detached house requires the insertion of approximately 140 wall tie bolts. The number of houses affected by the problem of deteriorating wall ties in the United Kingdom could be considerable, extending into many thousands. The deterioration of the ties is progressive and by the end of the century will be a major national problem. Although at this time the emphasis is on older houses constructed in black mortar, it is known that the metal in wall ties in more modern houses is being affected similarly by chlorates in cement mortar and therefore the problem could be even greater than now anticipated. Nothing short of partial or complete demolition of external walls and rebuilding is the present approach to reinstate the stability of a house. Utilization of fixing devices as herein described gives a solution to the problem whereby the property can be made stable without removing the occupants of the house, with a minimum of damage requiring making good, and at far less expense.

It is to be understood that although the present fixing devices have been described as used as wall ties, the devices have applications wherever it may be desired to provide an anchorage firmly locked to each of two spaced-apart members Furthermore, as the device is locked first to one member independently of the other member, and then to the other member, the torque applied can be different for each member and can therefore be selected to suit two members of very different materials, for example one able to withstand very high torque and another only able to withstand low torque.

For the particular device described above in detail, the tool for tightening the first nut 8 is a screw driver having a central bore so that it can be slid along the bolt 2 until opposed blade portions directed radially of the bore at the free end of the tool engage corresponding screw driver slot portions in the nut. To enhance the engagement between tool and nut, the blade and corresponding slot portions can be of more complex configuration, for example cruciform, and, in place of some or all of the slot portions in the nut, upstanding lugs can be provided for engagement with corresponding slots provided in the driving tool.

We claim:

1. A fixing device that can be anchored in bores formed co-axially in each of two spaced-apart members, the device comprising a screw-threaded member that can be passed through the bore in one member so as to extend through this one member and into the bore in the other member with one end terminating in the bore in said other member; a stop at said one end of the screw-threaded member fast with the screw-threaded member; a first sleeve mountable on the screw-threaded member so as to be entered in the bore in said other member and between the stop and a first nut mountable on the screw-threaded member for rotation along the screw-threaded member and with respect to the first sleeve to apply axial force to the first sleeve; a second sleeve mountable on the screw-threaded member so as to be entered in the bore in said one member and between said first nut and a second nut mountable on the screw-threaded member for rotation along the screw-threaded member and with respect to the second sleeve to apply axial force to the second sleeve; the first and second sleeves being of deformable material such that axial force applied by said first nut expands the first sleeve in the bore in said other member to lock the device in this bore, and axial force applied by said second nut expands the second sleeve in the bore in said one member to lock the device in this bore, said first nut being actuable prior to actuation of said second nut.

2. A fixing device as claimed in claim 1, and comprising a sleeve of rigid material between each nut and its associated sleeve of deformable material, axial force applied by the nut being applied via the associated sleeve of rigid material to the associated sleeve of deformable material.

3. A fixing device as claimed in claim 2, and comprising a further sleeve of rigid material mountable on the screw-threaded member between the first nut and the second sleeve of deformable material.

4. A fixing device as claimed in claim 2 or 3, wherein the device is a wall tie for bridging the two spaced-apart leaves of a cavity wall, these leaves constituting said two members; and wherein the device comprises two more sleeves mountable on the screw-threaded member between the first nut and the sleeve of rigid material that is between the first nut and the first sleeve of deformable material so that axial force applied by this nut is applied via these two sleeves and this sleeve of rigid material to the first sleeve of deformable material; said two more sleeves when operative being disposed so that that one which is remote from the first nut is disposed in the cavity between said two leaves, this one sleeve being of deformable material and the other of these two sleeves being of rigid material whereby the one sleeve of deformable material expands freely laterally within the cavity when axial force is applied by said first nut.

5. A fixing device as claimed in claim 4, wherein the screw-threaded member, each nut and each sleeve of rigid material is of stainless steel, and wherein each sleeve of deformable material is of polyvinylchloride.

* * * * *